US009097249B2

(12) United States Patent
Petersen

(10) Patent No.: US 9,097,249 B2
(45) Date of Patent: Aug. 4, 2015

(54) PUMP GEAR

(75) Inventor: Dirk Petersen, Travenbruck (DE)

(73) Assignee: BRAN+LUEBBE GMBH, Norderstedt (DE)

( * ) Notice: Subject to any disclaimer, the term of this patent is extended or adjusted under 35 U.S.C. 154(b) by 735 days.

(21) Appl. No.: 11/473,053

(22) Filed: Jun. 23, 2006

(65) Prior Publication Data

US 2007/0098580 A1 May 3, 2007

(30) Foreign Application Priority Data

Jun. 24, 2005 (DE) ..... 10 2005 029 481

(51) Int. Cl.
*F04B 1/04* (2006.01)
*F04B 53/00* (2006.01)

(52) U.S. Cl.
CPC ..... *F04B 53/006* (2013.01); *F04B 1/0413* (2013.01); *F04B 1/0421* (2013.01)

(58) Field of Classification Search
CPC ..... F04B 1/0413; F04B 1/0421
USPC ..... 417/271, 273; 74/25, 579 R
See application file for complete search history.

(56) References Cited

U.S. PATENT DOCUMENTS 1,726,633 A 9/1929 Smith
2,454,600 A * 11/1948 Fischer ..... 92/59
2,572,711 A * 10/1951 Fischer ..... 417/238
3,633,552 A * 1/1972 Huber ..... 123/48 R
3,692,434 A * 9/1972 Schnear ..... 417/360
3,757,581 A * 9/1973 Mankin et al. ..... 73/247
4,264,286 A * 4/1981 Reinkemeyer ..... 417/539
4,381,179 A * 4/1983 Pareja ..... 417/273
4,498,372 A * 2/1985 Pareja ..... 92/187
4,555,961 A * 12/1985 Fischer ..... 74/579 E
4,850,313 A * 7/1989 Gibbons ..... 123/54.2
5,511,956 A * 4/1996 Hasegawa et al. ..... 417/271
5,778,835 A * 7/1998 Vought ..... 123/55.5
5,875,744 A * 3/1999 Vallejos ..... 123/44 R
6,401,472 B2 * 6/2002 Pollrich et al. ..... 62/228.4
6,832,900 B2 * 12/2004 Leu ..... 417/419
7,185,615 B2 * 3/2007 Sato et al. ..... 123/48 B
2003/0209219 A1 * 11/2003 Klomp et al. ..... 123/197.4

FOREIGN PATENT DOCUMENTS

DE 32 21 912 6/1989
DE 199 18 161 11/2000

* cited by examiner

*Primary Examiner* — Christopher Bobishi
(74) *Attorney, Agent, or Firm* — Baker & Hostetler LLP

(57) ABSTRACT

A pump mechanism having multiple cylinders, whose axes are situated around a crankshaft to enclose predetermined angles, and whose pistons are each functionally connected to a connecting rod mounted on a crank on the crankshaft, each connecting rod being mounted on its own crank and the cranks having a predetermined angular offset to one another. This angular offset of the cranks is selected in accordance with the angle which the cylinder axes enclose in such a way that the phase shifts between each two pistons of the cylinders actuated in sequence during a rotation of the crankshaft are equally large.

18 Claims, 6 Drawing Sheets

PUMP GEAR

CROSS-REFERENCE TO RELATED APPLICATIONS

This application claims priority to German Patent Application No. 102005029481.2, filed Jun. 24, 2005, the entire disclosure of which being incorporated herein by reference.

FIELD OF THE INVENTION

The present invention relates to a pump mechanism having multiple cylinders, whose axes are situated around a crankshaft to enclose predetermined angles, and whose pistons are each functionally connected to a connecting rod mounted on a crank on the crankshaft.

BACKGROUND OF THE INVENTION

Multiple cylinder pump mechanisms are used in process pumps for delivering large delivery streams or at high pressures. Usually, diaphragm pump heads are used as the pump heads in this case. Since the diaphragms used therein are only capable of limited deflection, diaphragm pump heads having very large diameters are required for large delivery volumes. If such large diaphragm pump heads are to be operated using a multiple cylinder mechanism, the intervals of the pump head holders and/or the cylinders must therefore also be large enough. In typical pump mechanisms, the individual cylinders are typically situated in parallel and mounted horizontally on a crankshaft which also lies horizontally. In this case, a large cylinder interval in the connection area for the pump heads also requires a large mounting interval on the crankshaft. In the event of multiple cylinders and large pump heads, the crankshaft must be designed correspondingly long. This in turn requires special properties of the crankshaft, in particular in regard to stability and flexural strength. High costs in production and storage result due to this and due to the large amount of space required. Efforts to develop high-performance pump mechanisms which require less space have resulted from this.

A multiple cylinder diaphragm pump, in which the cylinder pistons are mounted on a single eccentric on a crankshaft, is known from German Utility Model DE G8521520.1 U1. The individual cylinders are situated radially around the crankshaft in this case. The crankshaft itself is accordingly comparatively short. In order to achieve uniform superposition of the partial delivery streams of the individual cylinders, the angles at which the cylinders stand to one another are distributed uniformly around 360°. The radial arrangement of the cylinders is connected to significant disadvantages, however. Firstly, the overall pump is thus relatively protrusive, and the space required by the pump is still unsatisfactory, in addition, the accessibility of the rear cylinders is significantly restricted when the pump is installed. Furthermore, the piping requires a special outlay.

From this background, it is the object of the present invention to specify a pump mechanism which is especially compact and has a short crankshaft while simultaneously having good accessibility of the individual cylinders.

SUMMARY OF THE INVENTION

The object is achieved by a pump mechanism having multiple cylinders, whose axes are situated around a crankshaft enclosing predetermined angles, and whose pistons are each linked to a connecting rod mounted on a crank on a crankshaft, each connecting rod being mounted on its own crank and the cranks having a predetermined angular offset to one another. The angular offset of these cranks is selected according to the present invention as a function of the angle which the cylinder axes enclose in such a way that the phase shifts between each two pistons of the cylinders actuated in sequence during a rotation of the crankshaft are equally large.

The angles which the cylinder axes enclose are to be viewed in this case in projection on a plane perpendicular to the longitudinal axis of the crankshaft. The cylinder axes actually do not intersect, since the attack points of the connecting rods on the particular cranks are offset along the longitudinal axis of the crankshaft. In the projection, however, the cylinder axes intersect in the crankshaft and extend therefrom radially. The angular distribution between the cylinder axes may be selected nearly arbitrarily around the crankshaft. Only the minimum angle between two neighboring cylinder axes is predefined by the dimensions of the cylinder and the pump heads to be attached. Both symmetric arrangements having regular angular intervals of the cylinders and also asymmetric arrangements are possible. The manifold possibilities of the geometric arrangement offers the advantage that the pump may be adapted to many different construction conditions, for example, when it is to be integrated into a more complex facility.

In order that the most uniform possible torque curve during a rotation of the crankshaft is achieved in spite of an asymmetric arrangement of the cylinders around the crankshaft, the angles at which the cranks stand to one another are tailored to the angular distribution of the cylinders. The cranks, on which the connecting rods of the individual cylinders arc mounted, must therefore be offset to one another around the axis of the crankshaft by a specific angle in each case. The angular offset between the cranks is then selected so that the phase shifts between the work cycles of two sequentially actuated pistons are each equally large. In a three-cylinder mechanism, the phase difference between the work cycles of two cylinders, independently of the spatial arrangement of the cylinders, is thus 120° in each case. In a four-cylinder mechanism, the phase difference of two sequentially actuated cylinders is 90° in each case. In this way, it is ensured that the partial delivery streams of the individual cylinders are superimposed uniformly and pressure pulsations which are too strong do not occur. A more uniform delivery stream using arbitrary angles of the cylinder axes may thus be produced through the angular offset of the cranks.

The pump mechanism according to the present invention is especially suitable for the attachment of piston diaphragm pump heads. For trouble-free operation of piston diaphragm pump heads, horizontal piston axes having valve connections lying one on top of another, which are oriented perpendicularly thereto, are preferred. The crankshaft is thus expediently mounted standing vertically, the cylinder axes pointing horizontally radially away therefrom.

The linkage of the pistons by the connecting rod is preferably performed via a crosshead, which absorbs the transverse components of the rotational movement of the connecting rods originating from the crankshaft.

The cranks for the individual connecting rods and cylinders are distributed along the longitudinal axis of the crankshaft. With a vertically mounted crankshaft, this means that the connecting rod main bearings, using which the connecting rods are each mounted on their own crank, are offset in height to one another. Since the connecting rods extend horizontally from the crankshaft in this case, the outer connecting rod ends are also offset in height to one another. In a preferred embodiment variation, this height offset corresponds precisely to the thickness of the connecting rods. The cranks lie so close to one another that the connecting rods slide on one another without noticeable spatial separation. If the connections of connecting rods to crosshead and crosshead to cylinder pistons are central, a corresponding height offset of the cylinder axes by one connecting rod thickness each results therefrom. The cylinder axes then extend, strictly speaking, in a fan shape or similarly to the steps of a spiral staircase from the crankshaft.

The cylinders in the pump mechanism according to the present invention are preferably situated so that the sum of the angles enclosed by the cylinder axes is less than or equal to 180°. The cylinder axes are thus not distributed around the crankshaft, but rather project from the crankshaft only in a half space. This means that there are preferably two outermost cylinders, whose axes enclose an angle of less than 180° of one another, or which extend parallel in opposite directions from the crankshaft. For the case that the pump mechanism has more than these two outermost cylinders, they are distributed in a fan shape between the two outermost cylinders, while no cylinder axes project into the second half space. The asymmetrical cylinder distribution is taken into consideration by the angular offset of the cranks, so that nonetheless a uniform delivery stream occurs. When the pump is installed in a facility, the restriction of the space for cylinder connections to 180° has the advantage that all cylinders are accessible from one side for maintenance work, for example.

The pump mechanism according to the present invention preferably has three cylinders. If the cylinder axes are distributed on 180°, these cylinders may each be at an angle of 90° to one another.

In an especially preferred refinement, the three cylinder axes are only distributed over an angular range of 90°, however, and the individual cylinders are then each at an angle of 45° to one another. This arrangement allows an even more compact embodiment of the pump. The accessibility from one side is improved even further. Depending on the special requirements, for example, arrangements at angles of 30° and 60° or other angle combinations are also possible.

The pump mechanism may be driven using a worm gear pair or an external geared motor which may be coupled directly to the crankshaft. Therefore, the crankshaft has both a coupling for such an external transmission and also a connection device for a worm gear pair in a preferred refinement. If the pump mechanism is enclosed by a housing, both drive possibilities are expediently possible using the same basic variation of a housing. The worm gear pair may be integrated in the housing, while the external transmission may be mounted externally on the housing in an extension of the crankshaft. The drive motor is then either mounted laterally directly on the housing for the drive via the worm gear pair, or adjoining the housing for drive via the external transmission. A stroke frequency suitable for diaphragm pumps may be generated using both types of drive. Such a frequency is typically below 250 strokes per minute. The drive of the pump mechanism via a worm gear pair has the advantage that multiple pump mechanisms may be chained horizontally via a connection of the worm shafts. A vertical chaining of multiple mechanisms is possible with both types of drive. For this purpose, the crankshafts of multiple pumps may be coupled to one another. In this case, it is possible to position the pump heads on the same side or also alternately.

In a preferred embodiment variation of the pump mechanism having three cylinders, which enclose an angle of 90° overall, the crankshaft is driven via a worm gear pair. The drive motor, whose axis is perpendicular to the crankshaft, of course, is preferably mounted in such a way that its axis encloses an angle of less than or equal to 135° with the axis of the middle cylinder. Cylinders and drive motor are then situated in a fan shape around the crankshaft. If the worm engages on the crankshaft in proximity to the cranks, the crankshaft may be implemented as correspondingly short, and an especially compact flat construction of the pump is possible.

In all above-mentioned embodiment variations, these cylinders are each offset by one connecting rod thickness in the direction of the longitudinal axis of the crankshaft and do not lie in one plane. This may make increased complexity necessary during connection of the pump, in the piping, for example. This constructive disadvantage may be avoided in a preferred embodiment if one or more connecting rods are bent in such a way that the outer ends of all connecting rods facing away from the crankshaft lie in one plane, while the other ends are mounted next to one another and/or, with a vertical crankshaft, one on top of another on the crankshaft, of course. For a three-cylinder pump, at least two such bent connecting rods are necessary so that all connecting rod ends facing away from the crankshaft may lie in one plane. In another preferred variation, the height offset of the cylinder axes is avoided in that either the connecting rods engage off center on the crossheads or the crossheads engage off center on the pistons. In this way, the crosshead tracks, or at least the cylinder heads, may be brought into one plane. A combination of both cited measures is also expedient.

For the mounting of the connecting rods on the crankshaft, the crankshaft is preferably assembled from at least two parts along its length. The division is expediently located in the area of the cranks. The torque transmission is then ensured by a formfitting shaft-hub connection. Possible embodiments are, inter alia, a multi-tooth or polygonal profile or a feather key. A dividable crankshaft allows the use of multiple identical connecting rods, or at least connecting rods having identically shaped closed main bearings, for all cylinders. Storage and production costs may thus be lowered and/or kept low. For three-cylinder or four-cylinder pump mechanisms, the crankshaft must be assembled from at least two parts for this purpose. For a larger number of cylinders, more parts are correspondingly required.

If an undivided crankshaft is used for a pump mechanism having at least three cylinders, at least one main bearing of the connecting rod preferably has a divided bearing shell. In a three-cylinder mechanism, the middle connecting rod main bearing is then expediently implemented as divided. The mounting of more than two connecting rods on an undivided crankshaft may also alternatively be made possible through different diameters of the connecting rod main bearings. In particular for pump mechanisms having a larger number of cylinders, the combination of a divided crankshaft with divided connecting rod main bearings or connecting rod main bearings of different diameters may be advisable. The crankshaft itself is preferably mounted in at least two main bearings on its ends, on both sides of the cranks. For this purpose, both friction bearing and also roller bearing technology may be used.

The pump mechanism is expediently installed in a housing. The housing is preferably manufactured from one part and equipped with a closable opening in each of the floor and the rear wall for mounting. The inner workings of the pump, i.e., the single-part or multipart crankshaft and the connecting rods, may be mounted through these openings.

In a preferred refinement, the crosshead tracks of the cylinders and the pump head holders are integrated in the housing. The individual pump head holders may then be connected to one another. This has the advantage that pressure differences in the housing which arise due to the oscillating movements of the crossheads and pistons may be compensated for even with sealed housing openings, since the required air mass equalization may occur between the cylinders. In addition, the housing volumes connected to one another may be used as a reservoir for hydraulic oil in special construction variations of diaphragm pump heads.

The object of the present invention is also achieved by a pump having a pump mechanism according to the present invention. Diaphragm pump heads are preferably connected to the pump head holders of the cylinders.

BRIEF DESCRIPTION OF THE DRAWINGS

In the following, the present invention is explained in greater detail on the basis of exemplary embodiments illustrated in the drawing.

DETAILED DESCRIPTION

Figure 1:
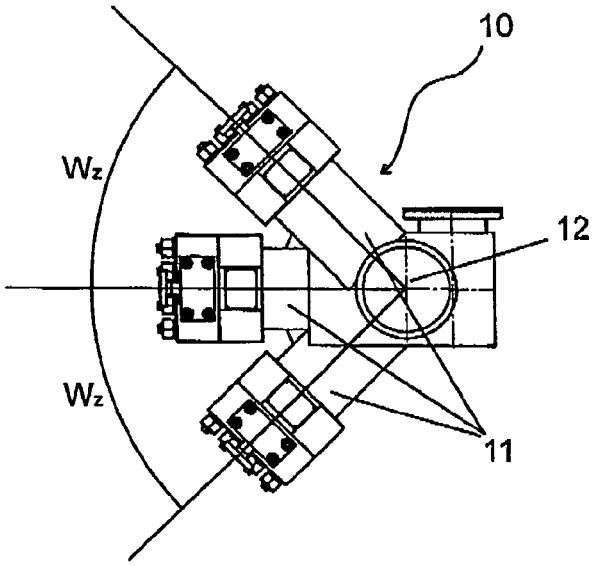
FIG. 1: schematically shows a pump mechanism having three cylinders in angular distribution around the crankshaft indicated.
Figure 2:
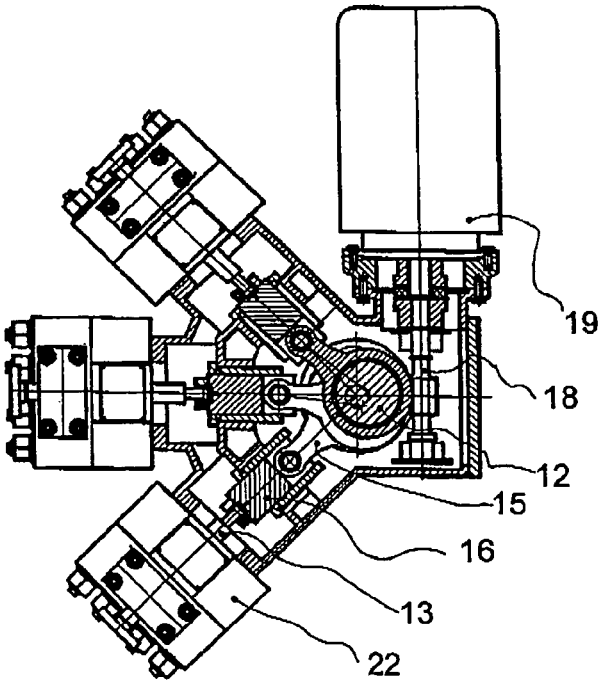
FIG. 2: schematically shows a pump mechanism and vertical crankshaft in horizontal section.
Figure 3:
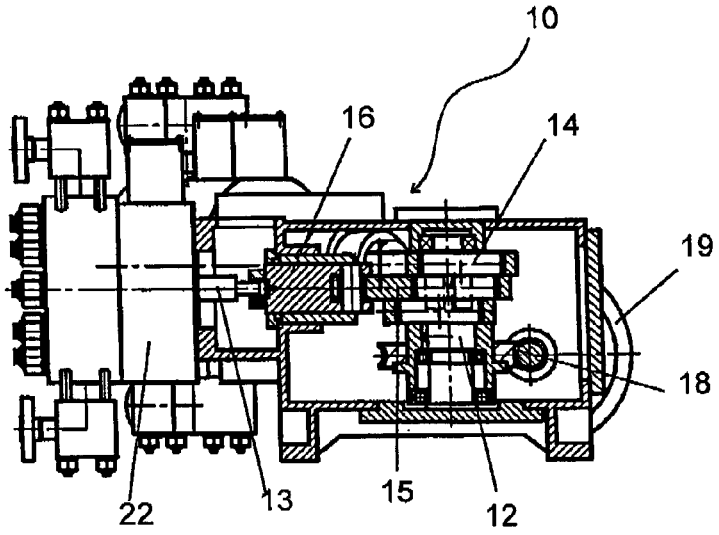
FIG. 3: schematically shows the pump mechanism from FIG. 2 in vertical section.
Figure 4:
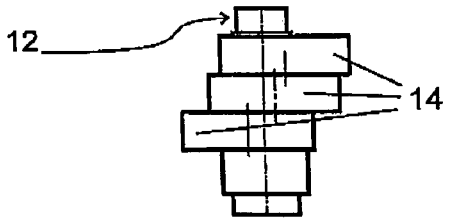
FIG. 4: schematically shows a crankshaft having cranks in vertical section along the longitudinal axis of the crankshaft.
Figure 5:
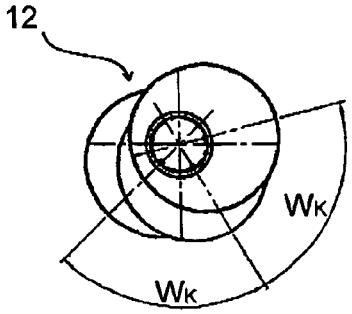
FIG. 5: schematically shows a crankshaft in a top view having angular offset of the cranks indicated.
Figure 6:
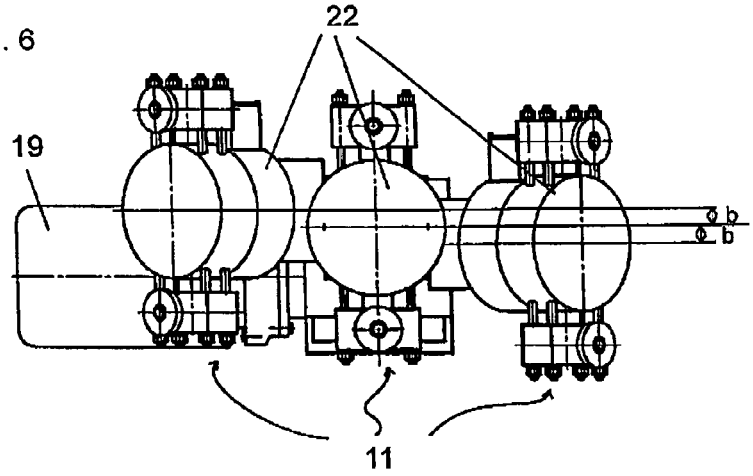
FIG. 6: schematically shows a three-cylinder pump mechanism having symmetrical angular distribution of the cylinder axes and installed diaphragm pump heads in a front view of the front side of the middle cylinder.
Figure 7:
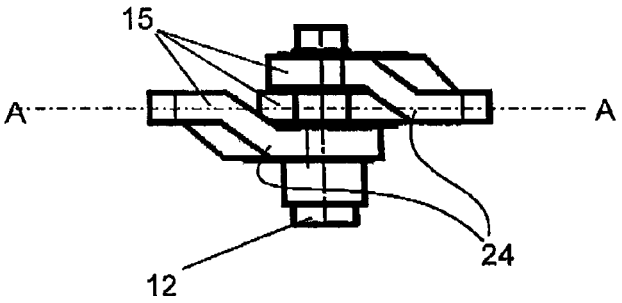
FIG. 7: schematically shows a crankshaft having bent connecting rods in section along the longitudinal axis of the crankshaft.
Figure 8:
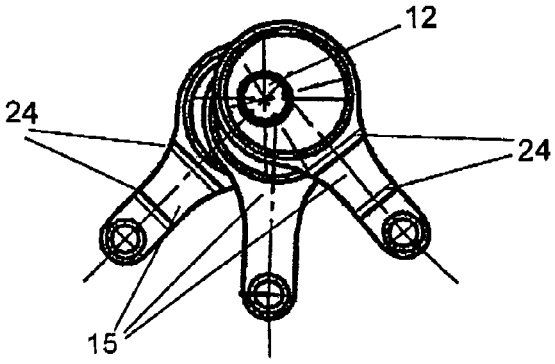
FIG. 8: schematically shows a crankshaft having bent connecting rods in a top view of the front side of the crankshaft.

FIG. 1 shows a possible geometric arrangement of the pump mechanism 10 according to the present invention having three cylinders 11 seen from above. The cylinders 11 point horizontally away radially from the vertically oriented crankshaft 12. They are symmetrically situated in this embodiment and each enclose an angle $W_Z$ with one another in the projection shown on a plane perpendicular to the crankshaft 12. A pump mechanism 10 having the same geometry is shown in greater detail in FIG. 2. The sectional plane of the drawing runs through the connecting rod 15 mounted uppermost. The two other connecting rods 15 are mounted without spacing directly below the uppermost connecting rod 15 on the crankshaft 12. The vertical crankshaft 12 is driven via a horizontal worm gear pair 18 using a drive motor 19. The three connecting rods 15 are each mounted on their own crank 14 on the crankshaft 12. On their other end, facing away from the crankshaft 12, they are linked to a crosshead 16. This converts the rotational movement of the connecting rods 15 into a linear movement. This movement is transmitted to a piston 13 via a piston rod. This in turn links the diaphragms of the attached pump heads 22. The same exemplary embodiment is shown in FIG. 3 in vertical section. The connecting rods 15, which are mounted without spacing one on top of another on the crankshaft 12, are visible here. The crankshaft 12, having the cranks 14 lying directly one on top of another, is shown once again in FIG. 4 in detail in a side view. The cranks appear horizontally shifted in this view, but actually they have an angular offset $W_K$ to one another, as may be seen in FIG. 5 in the top view. This angular offset $W_K$ is tailored to the angle between the cylinders $W_Z$. In the symmetrical embodiment variation having three cylinders shown in FIGS. 1 and 2, the relationship $W_K=120°-W_Z$ applies, $W_K$ identifying the angular offset of the cranks 14 and $W_Z$ identifying the intermediate angle of the cylinders 11. With identically shaped connecting rods and identical attachment of the crosshead tracks 25, pistons 13, and pump heads 22, the pump heads 22 have a height offset b to one another, which corresponds to the thickness of the connecting rods. FIG. 6 shows this height offset in an embodiment variation as shown in FIGS. 1 and 2 from the viewpoint of the middle pump head. This height offset of the cylinders makes installation of the pump mechanism according to the present invention more difficult and additionally causes an increased space requirement in the vertical direction unnecessarily. In order to avoid this disadvantage, one or more connecting rods 15 may be designed as bent, so that the connecting rod ends facing away from the crankshaft 12 all lie in one horizontal plane. FIG. 7 shows a vertical crankshaft 12 having three connecting rods mounted thereon, the middle connecting rod being implemented as straight and both the upper and the lower connecting rod 15 being bent in such a way that the ends all lie on the plane A-A of the middle connecting rod 15. In FIG. 8, this is shown once again in a top view of the vertical crankshaft 12. The bends in the two outer connecting rods are shown by lines 24.

Figure 9:
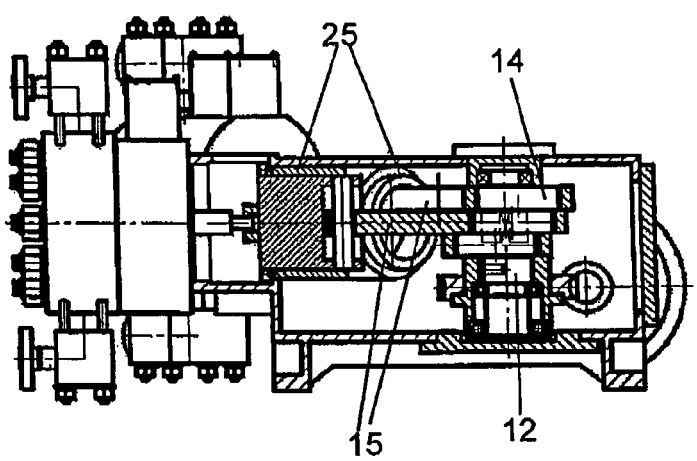
FIG. 9: schematically shows a vertical section through a multiple cylinder pump mechanism having vertical crankshaft and cylinders lying horizontally in one plane.
Figure 10:
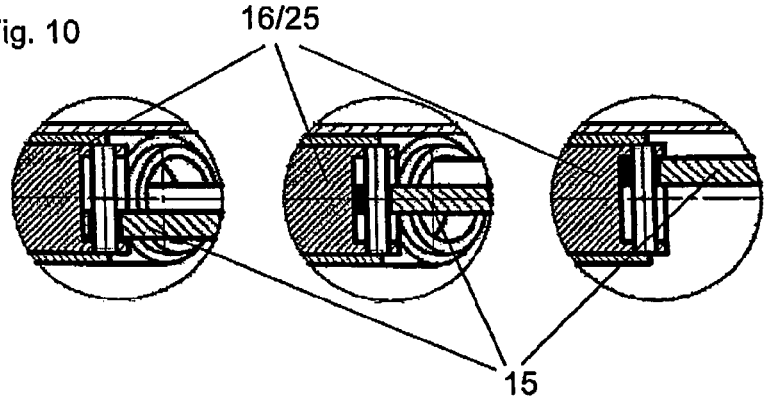
FIG. 10: schematically shows a detail view of the connection of connecting rods to crosshead in three different positions.
Figure 11:
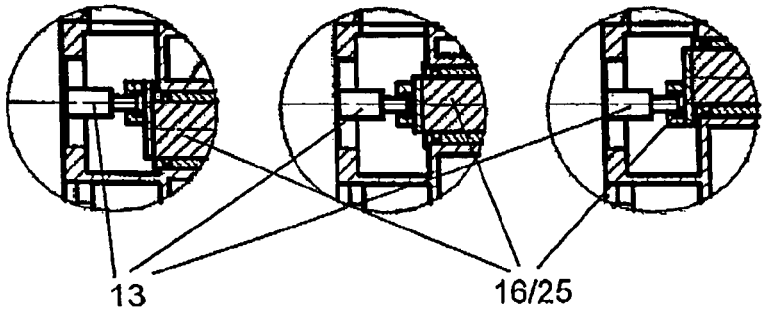
FIG. 11: schematically shows a detail view of the connection of crosshead to pistons in three different positions.

Another possibility for compensating for the height offset b is used in the refinements shown in FIGS. 9 through 11. FIG. 9 again shows a pump mechanism in vertical section. In the center, a crosshead track 25 is shown in section and the opening to a neighboring crosshead track is shown behind it in perspective. Both crosshead tracks are located at the same height in spite of unbent connecting rods 15 mounted one on top of another on the crankshaft 12. The height offset b is compensated for here in that the connecting rods do not engage centrally on the crosshead, but rather, depending on the position on the crankshaft, either below or above the middle of the crosshead 16. The connecting rod 15 mounted lower on the lowermost crank 14 then also engages below the middle on the crosshead 16. This is shown in detail in FIG. 10 on the very left. The middle connecting rod 15, which engages in the middle of the crosshead 16, is shown in the middle in FIG. 10. On the right, the uppermost connecting rod 15 accordingly engages above the middle on the crosshead 16.

FIG. 11 shows another embodiment variation in which the crosshead tracks 25 also have a height offset. This is first compensated for during the transmission of the movement to the piston 13, in that this is accordingly linked above or below the crosshead center.

Figure 12:
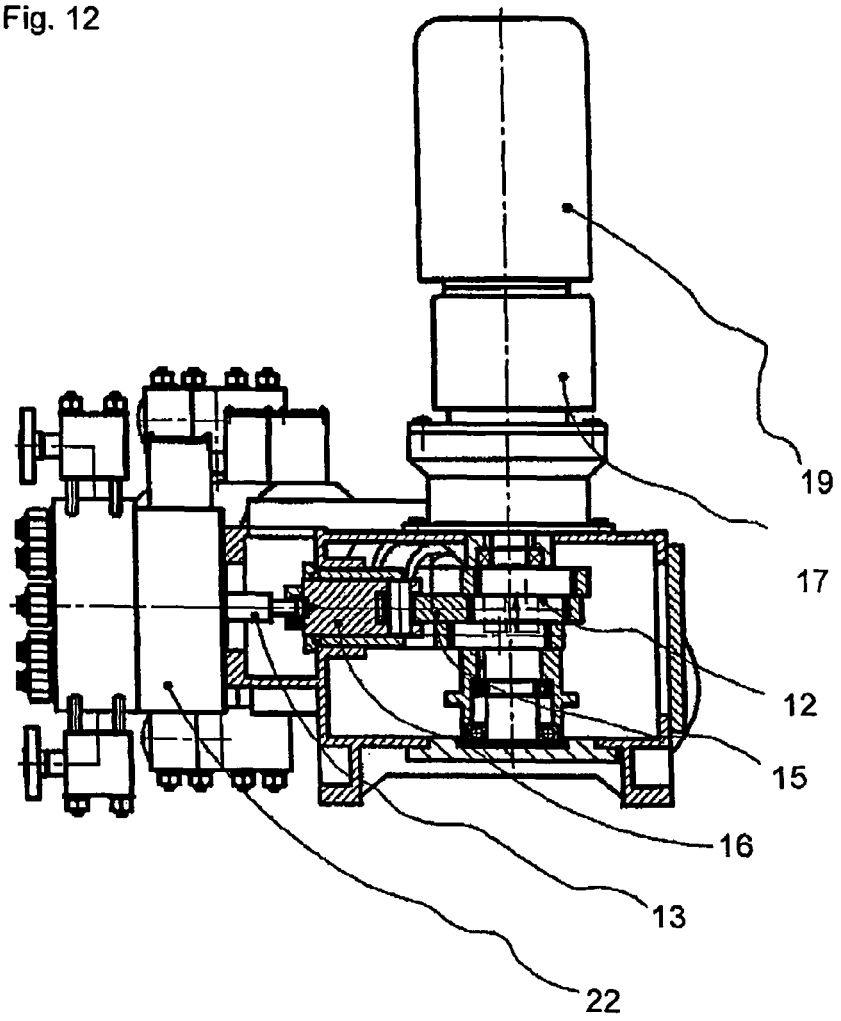
FIG. 12: schematically shows a vertical section through a pump mechanism having vertical crankshaft and external transmission and drive motor coupled directly to the crankshaft.

The pump mechanism 10 may alternately be driven via a worm gear pair 18 or via an external transmission 17 having a drive motor 19 which may be coupled directly to the crankshaft 12. FIG. 12 shows a pump mechanism corresponding to the embodiment in FIGS. 2 and 3 in vertical section, but with an external transmission 17 here. This is coupled to the upper end of the vertically mounted crankshaft 12. The drive motor 19 adjoins thereon.

Figure 13:
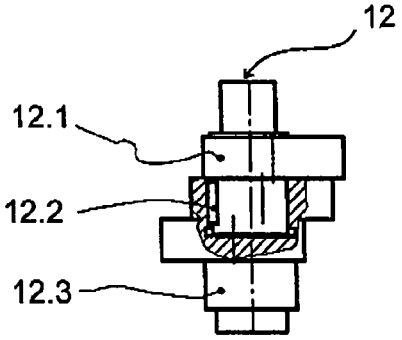
FIG. 13: schematically shows a dividable crankshaft in vertical section through the longitudinal axis.

In order that more than two identical connecting rods 15 may be mounted on the crankshaft 12, the crankshaft 12 is implemented as dividable in a special embodiment. FIG. 13 shows such a crankshaft 12 in longitudinal section. The division is in the area of the cranks 14. The crankshaft 12 shown is assembled from three parts 12.1, 12.2, and 12.3.

Figure 14:
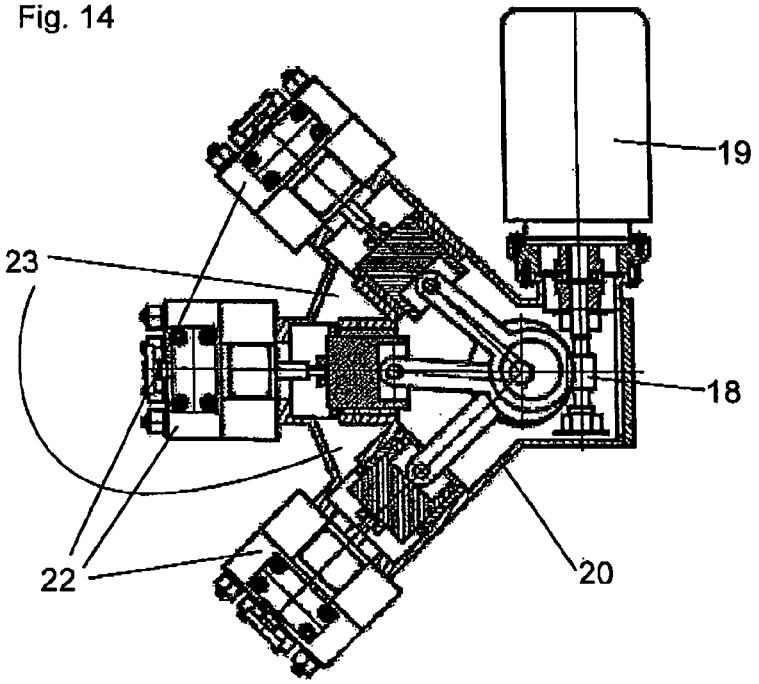
FIG. 14: schematically shows a pump mechanism having crosshead tracks and pump head holders integrated in the housing in horizontal section.

FIG. 14 shows a compact pump mechanism 10 in a housing 20. The individual crosshead tracks 25 are connected to one another via housing openings 23. This embodiment variation has a symmetrical angular distribution of the cylinders over 90°, as shown in FIGS. 1 through 3. The drive motor is additionally situated at an angle of 135° in relation to the middle cylinder. This special arrangement allows an especially compact embodiment of the pump mechanism according to the present invention. Depending on the size of the pump heads used, the angles between the cylinders and the drive motor may also be selected as even smaller.

The invention claimed is:

1. A pump mechanism comprising:

a crankshaft defining a crankshaft longitudinal axis therethrough;

three cylinders arranged around the crankshaft, each of the three cylinders defining a cylinder longitudinal axis therethrough, each cylinder longitudinal axis extending away from the crankshaft in a substantially radial direction relative to the crankshaft longitudinal axis, adjacent cylinder longitudinal axes enclosing predetermined angles (Wz) in a circumferential direction about the crankshaft longitudinal axis;

a diaphragm pump head coupled to each of the three cylinders; and a piston corresponding to each of the three cylinders, each piston being functionally connected to the crankshaft via a connecting rod, a first end of each connecting rod having a main bearing mounted on a crank of the crankshaft;

wherein each crank has a predetermined angular offset ($W_K$) relative to an adjacent crank, and the predetermined angular offset ($W_K$) is selected in accordance with the predetermined angles (Wz), in such a way that phase shifts between each piston and a sequentially actuated piston during a rotation of the crankshaft are equally large; and wherein a sum of the predetermined angles (Wz) between adjacent cylinder longitudinal axes, over all of the cylinder longitudinal axes, is equal to 90°, and wherein the longitudinal axes of the three cylinders are offset in height relative to one another in a direction along the crankshaft longitudinal axis that corresponds to a thickness of the connecting rod.

2. The pump mechanism according to claim 1, wherein each piston is connected to a corresponding connecting rod via a crosshead.

3. The pump mechanism according to claim 1, wherein neighboring connecting rods are mounted sequentially along a direction of the crankshaft longitudinal axis such that the neighboring connecting rods slide on one another without spatial separation along the direction of the crankshaft longitudinal axis.

4. The pump mechanism according claim 1, wherein the cylinder longitudinal axes of adjacent cylinders of the three cylinders enclose an angle (Wz) of 45° and the cylinder longitudinal axes of two outer cylinders of the three cylinders along the crankshaft longitudinal axis enclose an angle of 90°.

5. The pump mechanism according to claim 1, wherein the crankshaft is coupled to an external drive motor via a worm gear pair.

6. The pump mechanism according to claim 5, wherein the worm gear pair drives the crankshaft, a longitudinal axis of the external drive motor is perpendicular to the crankshaft longitudinal axis, and the longitudinal axis of the external drive motor encloses an angle of less than or equal to 135° with the cylinder longitudinal axis of a middle cylinder of the three cylinders.

7. The pump mechanism according to claim 1, wherein at least one of the connecting rods is linked to a crosshead outside a crosshead center.

8. The pump mechanism according to claim 1, wherein at least one of the pistons is linked to a crosshead outside a crosshead center.

9. The pump mechanism according to claim 1, wherein the crankshaft is assembled from at least two parts assembled along a longitudinal length of the crankshaft, and the at least two parts are configured for connection to one another in a formfitting way in an area of the cranks.

10. The pump mechanism according to claim 1, wherein the crankshaft has at least two crankshaft main bearings disposed on opposite sides of the cranks along the crankshaft longitudinal axis.

11. The pump mechanism according to claim 1, wherein the pump mechanism is installed in a housing, and wherein locations of the three cylinders are fixed with respect to the housing.

12. The pump mechanism according to claim 11, wherein the housing is manufactured in one part and is equipped with a closable opening in each of a floor and a rear wall for mounting.

13. The pump mechanism according to claim 11, wherein crosshead tracks and pump headholders are integrated in the housing and volumes of individual pump head holders are connected to one another.

14. The pump mechanism according to claim 13, wherein the crosshead tracks are located at a same height.

15. The pump mechanism according to claim 14, wherein each connecting rod is connected to different location of the crosshead tracks based on a position of each connecting rod along the crankshaft longitudinal axis.

16. The pump mechanism according to claim 1, wherein each piston is functionally connected to a second end of a corresponding connecting rod via a rotatable connection disposed at the second end of the corresponding connecting rod, the second end of the connecting rod being opposite the first end of the connecting rod.

17. The pump mechanism according to claim 16, wherein each piston is functionally connected to the crankshaft via a crosshead, and the crosshead is functionally connected to the second end of the corresponding connecting rod via the rotatable connection.

18. The pump mechanism according to claim 1, wherein the crankshaft is coupled to an external drive motor via an external transmission.

* * * * *